US011027545B2

(12) United States Patent
Lang et al.

(10) Patent No.: US 11,027,545 B2
(45) Date of Patent: Jun. 8, 2021

(54) FLUID EJECTION DEVICE

(71) Applicant: HEWLETT-PACKARD DEVELOPMENT COMPANY, L.P., Spring, TX (US)

(72) Inventors: Tracy A Lang, Corvallis, OR (US); Alexander Govyadinov, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/343,303

(22) PCT Filed: Jan. 31, 2017

(86) PCT No.: PCT/US2017/015819
§ 371 (c)(1),
(2) Date: Apr. 18, 2019

(87) PCT Pub. No.: WO2018/143936
PCT Pub. Date: Aug. 9, 2018

(65) Prior Publication Data

US 2019/0381793 A1 Dec. 19, 2019

(51) Int. Cl.
*B41J 2/14* (2006.01)
*B41J 2/175* (2006.01)

(52) U.S. Cl.
CPC ..... *B41J 2/14* (2013.01); *B41J 2/17596* (2013.01)

(58) Field of Classification Search
CPC ..... B41J 2/14; B41J 2/1433; B41J 2/17596; B41J 2002/14467; B41J 2202/12; B41J 2/14201; B41J 2/1404
See application file for complete search history.

(56) References Cited

U.S. PATENT DOCUMENTS 5,371,529 A 12/1994 Eguchi et al.
5,980,014 A 11/1999 Kagami
6,341,852 B1 * 1/2002 Yamamoto ..... B41J 2/04563 347/15
6,669,335 B2 2/2003 Tanaka et al.
6,582,054 B2 6/2003 Yamamoto et al.
6,648,447 B2 11/2003 Sugimoto et al.
7,281,783 B2 10/2007 Raman
(Continued)

FOREIGN PATENT DOCUMENTS

KR 20100112443 A 5/2012

OTHER PUBLICATIONS

Milne, S., Active Mixing and Switching Printheads Enable Programmable Control of Multimaterial 3D Printingm Sep. 23, 2015, < http://www.azom.com/news.aspx?newsID=44518 >.

*Primary Examiner* — Justin Seo
(74) *Attorney, Agent, or Firm* — Dicke Billig & Czaja PLLC

(57) ABSTRACT

A fluid ejection device includes a fluid ejection chamber having a drop ejecting element therein, a first fluid channel to communicate a first fluid with the fluid ejection chamber, a second fluid channel to communicate a second fluid different than the first fluid with the fluid ejection chamber, and a fluid pump communicated with one of the first fluid channel and the second fluid channel. As such, the fluid ejection chamber is to selectively eject drops of the first fluid, the second fluid, and a combination of the first fluid and the second fluid therefrom.

12 Claims, 5 Drawing Sheets

(56) References Cited

U.S. PATENT DOCUMENTS

| | | | |
|---|---|---|---|
| 9,010,891 | B2 | 4/2015 | Roof et al. |
| 2008/0100677 | A1 | 5/2008 | Boyer |
| 2013/0057622 | A1 | 3/2013 | Govyadinov et al. |
| 2013/0155135 | A1 | 6/2013 | Govyadinov et al. |
| 2014/0092170 | A1 | 4/2014 | Bustgens |

* cited by examiner

FLUID EJECTION DEVICE

BACKGROUND

Fluid ejection devices, such as printheads in inkjet printing systems, may use thermal resistors or piezoelectric material membranes as actuators within fluidic chambers to eject fluid drops (e.g., ink) from nozzles, such that properly sequenced ejection of ink drops from the nozzles causes characters or other images to be printed on a print medium as the printhead and the print medium move relative to each other.

DETAILED DESCRIPTION

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure.

Figure 1:
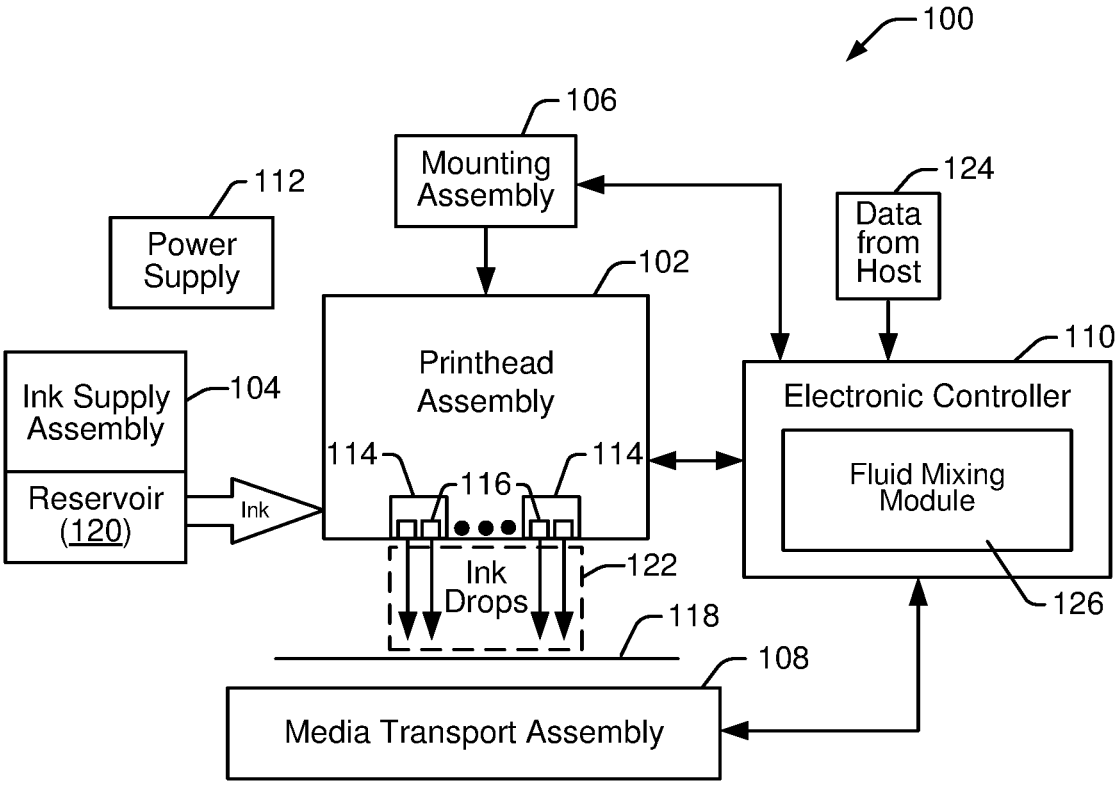
FIG. 1 is a block diagram illustrating one example of an inkjet printing system including an example of a fluid ejection device.

FIG. 1 illustrates one example of an inkjet printing system as an example of a fluid ejection device with fluid mixing, as disclosed herein. Inkjet printing system 100 includes a printhead assembly 102, an ink supply assembly 104, a mounting assembly 106, a media transport assembly 108, an electronic controller 110, and at least one power supply 112 that provides power to the various electrical components of inkjet printing system 100. Printhead assembly 102 includes at least one fluid ejection assembly 114 (printhead 114) that ejects drops of ink through a plurality of orifices or nozzles 116 toward a print medium 118 so as to print on print media 118.

Print media 118 can be any type of suitable sheet or roll material, such as paper, card stock, transparencies, Mylar, and the like, and may include rigid or semi-rigid material, such as cardboard or other panels. Nozzles 116 are typically arranged in one or more columns or arrays such that properly sequenced ejection of ink from nozzles 116 causes characters, symbols, and/or other graphics or images to be printed on print media 118 as printhead assembly 102 and print media 118 are moved relative to each other.

Ink supply assembly 104 supplies fluid ink to printhead assembly 102 and, in one example, includes a reservoir 120 for storing ink such that ink flows from reservoir 120 to printhead assembly 102. Ink supply assembly 104 and printhead assembly 102 can form a one-way ink delivery system or a recirculating ink delivery system. In a one-way ink delivery system, substantially all of the ink supplied to printhead assembly 102 is consumed during printing. In a recirculating ink delivery system, only a portion of the ink supplied to printhead assembly 102 is consumed during printing. Ink not consumed during printing is returned to ink supply assembly 104.

In one example, printhead assembly 102 and ink supply assembly 104 are housed together in an inkjet cartridge or pen. In another example, ink supply assembly 104 is separate from printhead assembly 102 and supplies ink to printhead assembly 102 through an interface connection, such as a supply tube. In either example, reservoir 120 of ink supply assembly 104 may be removed, replaced, and/or refilled. Where printhead assembly 102 and ink supply assembly 104 are housed together in an inkjet cartridge, reservoir 120 includes a local reservoir located within the cartridge as well as a larger reservoir located separately from the cartridge. The separate, larger reservoir serves to refill the local reservoir. Accordingly, the separate, larger reservoir and/or the local reservoir may be removed, replaced, and/or refilled.

Mounting assembly 106 positions printhead assembly 102 relative to media transport assembly 108, and media transport assembly 108 positions print media 118 relative to printhead assembly 102. Thus, a print zone 122 is defined adjacent to nozzles 116 in an area between printhead assembly 102 and print media 118. In one example, printhead assembly 102 is a scanning type printhead assembly. As such, mounting assembly 106 includes a carriage for moving printhead assembly 102 relative to media transport assembly 108 to scan print media 118. In another example, printhead assembly 102 is a non-scanning type printhead assembly. As such, mounting assembly 106 fixes printhead assembly 102 at a prescribed position relative to media transport assembly 108. Thus, media transport assembly 108 positions print media 118 relative to printhead assembly 102.

Electronic controller 110 typically includes a processor, firmware, software, one or more memory components including volatile and non-volatile memory components, and other printer electronics for communicating with and controlling printhead assembly 102, mounting assembly 106, and media transport assembly 108. Electronic controller 110 receives data 124 from a host system, such as a computer, and temporarily stores data 124 in a memory. Typically, data 124 is sent to inkjet printing system 100 along an electronic, infrared, optical, or other information transfer path. Data 124 represents, for example, a document and/or file to be printed. As such, data 124 forms a print job for inkjet printing system 100 and includes one or more print job commands and/or command parameters.

In one example, electronic controller 110 controls printhead assembly 102 for ejection of ink drops from nozzles 116. Thus, electronic controller 110 defines a pattern of ejected ink drops which form characters, symbols, and/or other graphics or images on print media 118. The pattern of ejected ink drops is determined by the print job commands and/or command parameters.

Printhead assembly 102 includes one or more printheads 114. In one example, printhead assembly 102 is a wide-array or multi-head printhead assembly. In one implementation of a wide-array assembly, printhead assembly 102 includes a carrier that carries a plurality of printheads 114, provides electrical communication between printheads 114 and electronic controller 110, and provides fluidic communication between printheads 114 and ink supply assembly 104.

In one example, inkjet printing system 100 is a drop-on-demand thermal inkjet printing system wherein printhead 114 is a thermal inkjet (TIJ) printhead. The thermal inkjet printhead implements a thermal resistor ejection element in an ink chamber to vaporize ink and create bubbles that force ink or other fluid drops out of nozzles 116. In another example, inkjet printing system 100 is a drop-on-demand piezoelectric inkjet printing system wherein printhead 114 is a piezoelectric inkjet (PIJ) printhead that implements a piezoelectric material actuator as an ejection element to generate pressure pulses that force ink drops out of nozzles 116.

Figure 2:
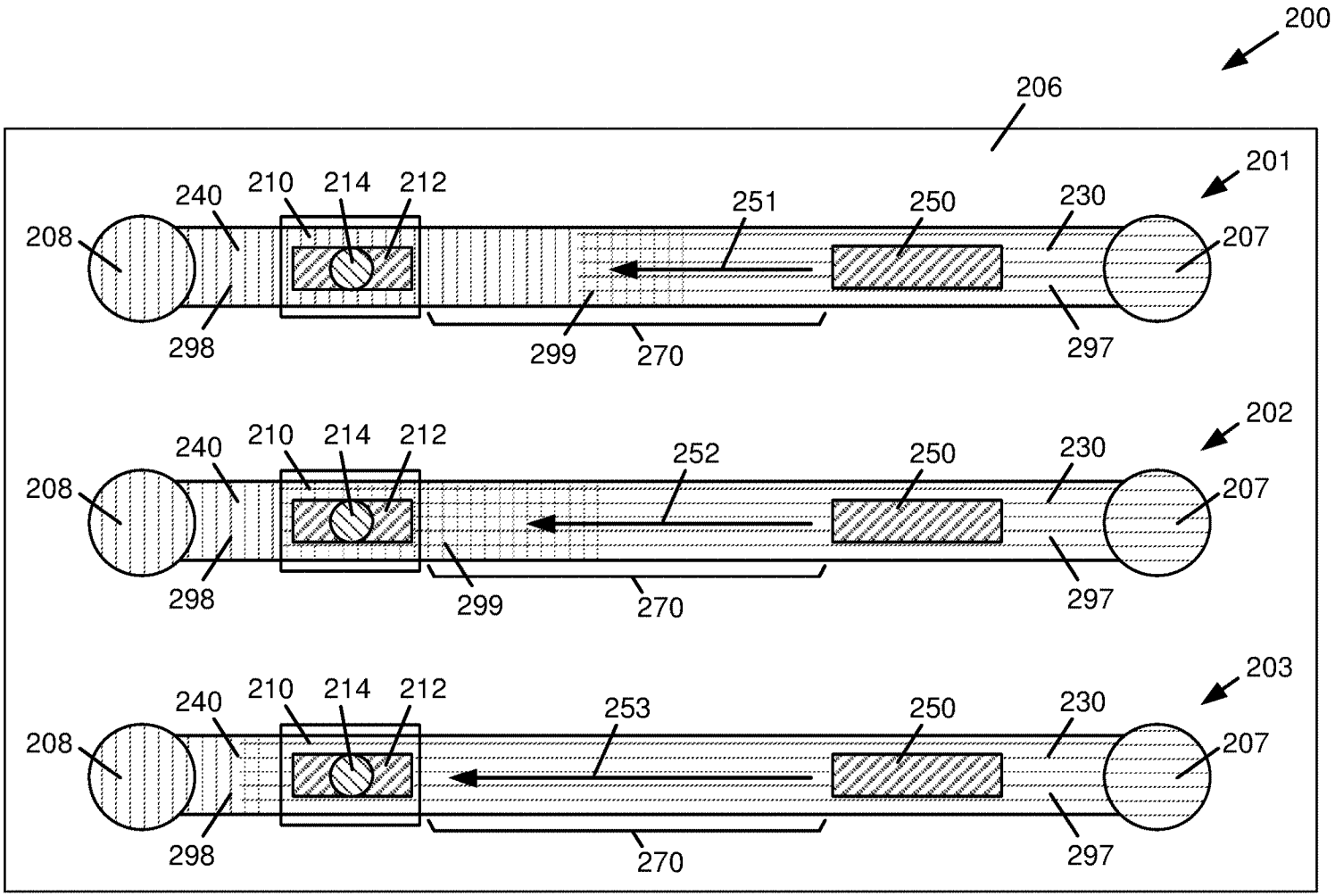
FIG. 2 is a schematic plan view illustrating an example of a portion of a fluid ejection device.

In one example, electronic controller 110 includes a fluid mixing module 126 stored in a memory of controller 110. Fluid mixing module 126 executes on electronic controller 110 (i.e., a processor of controller 110) to control the operation of one or more fluid actuators integrated as pump elements within printhead assembly 102 to control mixing of fluid within printhead assembly 102. FIG. 2 is a schematic plan view illustrating an example of a portion of a fluid ejection device 200. In one example, fluid ejection device 200 includes an array of fluid ejection devices, such as fluid ejection devices 201, 202, 203.

In one implementation, fluid ejection device 200, including, more specifically, each of fluid ejection devices 201, 202, 203, includes a fluid ejection chamber 210 with a corresponding drop ejecting element 212 formed in, provided within, or communicated with fluid ejection chamber 210, a first fluid channel 230 communicated with fluid ejection chamber 210, and a second fluid channel 240 communicated with fluid ejection chamber 210.

In one example, fluid ejection chamber 210 and corresponding drop ejecting element 212 are formed on a substrate 206. Substrate 206 may be formed, for example, of silicon, glass, or a stable polymer.

In one example, substrate 206 has a first fluid feed opening 207 formed therein and a second fluid feed opening 208 formed therein such that first fluid feed opening 207 provides a supply of a first fluid (or ink) to fluid ejection chamber 210 and corresponding drop ejecting element 212 via first fluid channel 230, and second fluid feed opening 208 provides a supply of a second fluid (or ink) to fluid ejection chamber 210 and corresponding drop ejecting element 212 via second fluid channel 240. First fluid feed opening 207 and second fluid feed opening 208 each include, for example, a hole, slot, passage, convex geometry or other fluidic architecture formed in or through substrate 206 by which or through which fluid is supplied to fluid ejection chamber 210. First fluid feed opening 207 and second fluid feed opening 208 each may include one (i.e., a single) or more than one (e.g., a series of) such hole, slot, passage, convex geometry or other fluidic architecture that communicates fluid with one (i.e., a single) or more than one fluid ejection chamber, and may be of circular, non-circular, or other shape.

In one example, fluid ejection chamber 210 is formed in or defined by a barrier layer (not shown) provided on substrate 206, such that fluid ejection chamber 210 provides a "well" in the barrier layer. The barrier layer may be formed, for example, of a photoimageable epoxy resin, such as SU8. In one example, a nozzle or orifice layer (not shown) is formed or extended over the barrier layer such that a nozzle opening or orifice 214 formed in the orifice layer communicates with respective fluid ejection chamber 210. Nozzle opening or orifice 214 may be of a circular, non-circular, or other shape.

Drop ejecting element 212 can be any device capable of ejecting fluid drops through corresponding nozzle opening or orifice 214. Examples of drop ejecting element 212 include a thermal resistor or a piezoelectric actuator. A thermal resistor, as an example of a drop ejecting element, may be formed on a surface of a substrate (substrate 206), and may include a thin-film stack including an oxide layer, a metal layer, and a passivation layer such that, when activated, heat from the thermal resistor vaporizes fluid in corresponding fluid ejection chamber 210, thereby causing a bubble that ejects a drop of fluid through corresponding nozzle opening or orifice 214. A piezoelectric actuator, as an example of a drop ejecting element, generally includes a piezoelectric material provided on a moveable membrane communicated with corresponding fluid ejection chamber 210 such that, when activated, the piezoelectric material causes deflection of the membrane relative to corresponding fluid ejection chamber 210, thereby generating a pressure pulse that ejects a drop of fluid through corresponding nozzle opening or orifice 214. Although illustrated as being of a rectangular shape, drop ejecting element 212 and corresponding fluid ejection chamber 210 each may be of a different shape and a different size.

As illustrated in the example of FIG. 2, fluid ejection device 200, including, more specifically, each of fluid ejection devices 201, 202, 203, includes a fluid pumping element 250 formed in, provided within, or communicated with first fluid channel 230. More specifically, fluid pumping element 250 is formed on, provided on, or integrated with substrate 206.

Fluid pumping element 250 forms or represents an actuator to pump fluid through first fluid channel 230. As such, fluid from first fluid feed opening 207 is forced or moved through first fluid channel 230 to fluid ejection chamber 210 based on flow induced by fluid pumping element 250.

In the example illustrated in FIG. 2, drop ejecting element 212 and fluid pumping element 250 are each thermal resistors. Each of the thermal resistors may include, for example, a single resistor, a split resistor, a comb resistor, or multiple resistors. A variety of other devices, however, can also be used to implement drop ejecting element 212 and fluid pumping element 250 including, for example, a piezoelectric actuator, an electrostatic (MEMS) membrane, a mechanical/impact driven membrane, a voice coil, and a magnetostrictive drive. As illustrated in the example of FIG. 2, first fluid channel 230 communicates with a first fluid (or ink), as represented by hatching 297, and second fluid channel 240 communicates with a second fluid (or ink), as represented by hatching 298. More specifically, in one implementation, first fluid channel 230 communicates with first fluid feed opening 207 to supply the first fluid (or ink) to fluid ejection chamber 210, and second fluid channel 240 communicates with second fluid feed opening 208 to supply the second fluid (or ink) to fluid ejection chamber 210.

In one implementation, fluid pumping element 250 may be operated to pump or move the first fluid toward, to (including into), and/or through fluid ejection chamber 210, as represented by arrows 251, 252, 253. In the illustrated example, a length of arrows 251, 252, 253 represents an example of a respective driving force of fluid pumping element 250 and, therefore, an example of a respective net result of fluid pumped and/or moved toward, to (including into), and/or through fluid ejection chamber 210.

As illustrated in the example of FIG. 2, a mixture or combination of the first fluid and the second fluid, including different ratios or concentrations of the first fluid and the second fluid, may be formed or created, as represented by combined hatching 299. In one example, a mixing zone 270, in which a mixture or combination of the first fluid and the second fluid may be formed or created, is provided or established between fluid pumping element 250 and fluid ejection chamber 210. In one implementation, mixing zone 270 includes fluid ejection chamber 210. Thus, with mixing zone 270, a mixture or combination of the first fluid and the second fluid is created or formed on substrate 206 of fluid ejection device 200.

As such, based on operation of fluid pumping element 250, fluid ejection device 200, including, more specifically, fluid ejection devices 201, 202, 203, may be operated to selectively or separately eject drops of the first fluid, drops of the second fluid, and drops of a combination or mixture of the first fluid and the second fluid, including different ratios or concentrations of the first fluid and the second fluid, from fluid ejection chamber 210.

In one example, as illustrated with fluid ejection device 201, a lesser amount of the first fluid, as represented by hatching 297, is pumped or moved toward fluid ejection chamber 210. As such, the second fluid, as represented by hatching 298, may be ejected from fluid ejection chamber 210.

In one example, as illustrated with fluid ejection device 202, the first fluid is pumped or moved toward and/or to fluid ejection chamber 210 such that the first fluid, as represented by hatching 297, and the second fluid, as represented by hatching 298, mix or combine in mixing zone 270, including in fluid ejection chamber 210. As such, a combination or mixture of the first fluid and the second fluid, as represented by combined hatching 299, may be ejected from fluid ejection chamber 210.

In one example, as illustrated with fluid ejection device 203, a greater amount of the first fluid, as represented by hatching 297, is pumped or moved to and/or through fluid ejection chamber 210. As such, the first fluid may be ejected from fluid ejection chamber 210.

Further to the illustrated example of FIG. 2, first fluid channel 230 and second fluid channel 240, including portions, sections, segments or regions thereof, may be of different or varying widths, and may be of different or varying lengths.

Figure 3:
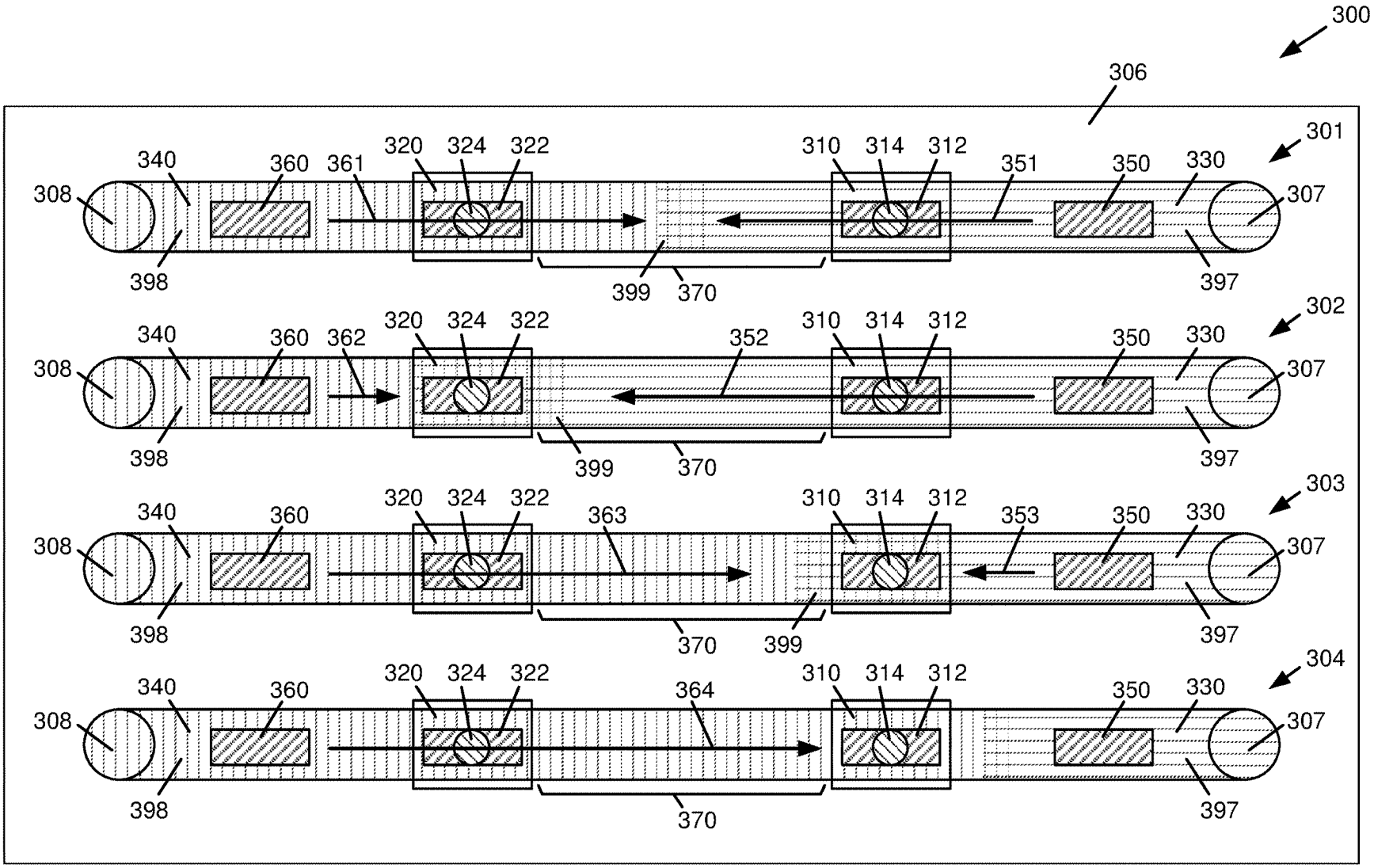
FIG. 3 is a schematic plan view illustrating an example of a portion of a fluid ejection device.

FIG. 3 is a schematic plan view illustrating an example of a portion of a fluid ejection device 300. In one example, fluid ejection device 300 includes an array of fluid ejection devices, such as fluid ejection devices 301, 302, 303, 304.

In one implementation, fluid ejection device 300, including, more specifically, each of fluid ejection devices 301, 302, 303, 304, includes a first fluid ejection chamber 310 with a corresponding drop ejecting element 312 formed in, provided within, or communicated with fluid ejection chamber 310, a second fluid ejection chamber 320 with a corresponding drop ejecting element 322 formed in, provided within, or communicated with fluid ejection chamber 320, a first fluid channel 330 communicated with fluid ejection chamber 310, and a second fluid channel 340 communicated with fluid ejection chamber 320.

In one example, fluid ejection chambers 310 and 320 and corresponding drop ejecting elements 312 and 322 are formed on a substrate 306. Substrate 306 may be formed, for example, of silicon, glass, or a stable polymer.

In one example, substrate 306 has a first fluid feed opening 307 formed therein and a second fluid feed opening 308 formed therein such that first fluid feed opening 307 provides a supply of a first fluid (or ink) to fluid ejection chamber 310 and corresponding drop ejecting element 312 via first fluid channel 330, and second fluid feed opening 308 provides a supply of a second fluid (or ink) to fluid ejection chamber 320 and corresponding drop ejecting element 322 via second fluid channel 340. First fluid feed opening 307 and second fluid feed opening 308 each include, for example, a hole, slot, passage, convex geometry or other fluidic architecture formed in or through substrate 306 by which or through which fluid is supplied to fluid ejection chambers 310 and 320. First fluid feed opening 307 and second fluid feed opening 308 each may include one (i.e., a single) or more than one (e.g., a series of) such hole, slot, passage, convex geometry or other fluidic architecture that communicates fluid with one (i.e., a single) or more than one fluid ejection chamber, and may be of circular, non-circular, or other shape.

In one example, fluid ejection chambers 310 and 320 are formed in or defined by a barrier layer (not shown) provided on substrate 306, such that fluid ejection chambers 310 and 320 each provide a "well" in the barrier layer. The barrier layer may be formed, for example, of a photoimageable epoxy resin, such as SU8. In one example, a nozzle or orifice layer (not shown) is formed or extended over the barrier layer such that nozzle openings or orifices 314 and 324 formed in the orifice layer communicate with respective fluid ejection chambers 310 and 320. Nozzle openings or orifices 314 and 324 may be of a circular, non-circular, or other shape.

Drop ejecting elements 312 and 322 can be any device capable of ejecting fluid drops through corresponding nozzle openings or orifices 314 and 324. Examples of drop ejecting elements 312 and 322 include a thermal resistor or a piezoelectric actuator. A thermal resistor, as an example of a drop ejecting element, may be formed on a surface of a substrate (substrate 306), and may include a thin-film stack including an oxide layer, a metal layer, and a passivation layer such that, when activated, heat from the thermal resistor vaporizes fluid in corresponding fluid ejection chamber 310 or 320, thereby causing a bubble that ejects a drop of fluid through corresponding nozzle opening or orifice 314 or 324. A piezoelectric actuator, as an example of a drop ejecting element, generally includes a piezoelectric material provided on a moveable membrane communicated with corresponding fluid ejection chamber 310 or 320 such that, when activated, the piezoelectric material causes deflection of the membrane relative to corresponding fluid ejection chamber 310 or 320, thereby generating a pressure pulse that ejects a drop of fluid through corresponding nozzle opening or orifice 314 or 324. Although illustrated as being of a rectangular shape, drop ejecting elements 312 and 322 and corresponding fluid ejection chambers 310 and 320 each may be of a different shape and a different size.

As illustrated in the example of FIG. 3, fluid ejection device 300, including, more specifically, each of fluid ejection devices 301, 302, 303, 304, includes a first fluid pumping element 350 formed in, provided within, or communicated with first fluid channel 330, and a second fluid pumping element 360 formed in, provided within, or communicated with second fluid channel 340. More specifically, fluid pumping element 350 and fluid pumping element 360 are each formed on, provided on, or integrated with substrate 306.

Fluid pumping element 350 forms or represents an actuator to pump fluid through first fluid channel 330, and fluid pumping element 360 forms or represents an actuator to pump fluid through second fluid channel 340. As such, fluid from first fluid feed opening 307 is forced or moved through first fluid channel 330 to fluid ejection chamber 310 based on flow induced by fluid pumping element 350, and fluid from second fluid feed opening 308 is forced or moved through second fluid channel 340 to fluid ejection chamber 320 based on flow induced by fluid pumping element 360.

In the example illustrated in FIG. 3, drop ejecting elements 312 and 322 and fluid pumping elements 350 and 360 are each thermal resistors. Each of the thermal resistors may include, for example, a single resistor, a split resistor, a comb resistor, or multiple resistors. A variety of other devices, however, can also be used to implement drop ejecting elements 312 and 322 and fluid pumping elements 350 and 360 including, for example, a piezoelectric actuator, an electrostatic (MEMS) membrane, a mechanical/impact driven membrane, a voice coil, and a magneto-strictive drive.

As illustrated in the example of FIG. 3, first fluid channel 330 communicates with a first fluid (or ink), as represented by hatching 397, and second fluid channel 340 communicates with a second fluid (or ink), as represented by hatching 398. More specifically, in one implementation, first fluid channel 330 communicates with first fluid feed opening 307 to supply the first fluid (or ink) to fluid ejection chamber 310, and second fluid channel 340 communicates with second fluid feed opening 308 to supply the second fluid (or ink) to fluid ejection chamber 320.

In one implementation, fluid pumping element 350 may be operated to pump or move the first fluid toward, to (including into), and/or through fluid ejection chamber 310, as represented by arrows 351, 352, 353, and fluid pumping element 360 may be operated to pump or move the second fluid toward, to (including into), and/or through fluid ejection chamber 320, as represented by arrows 361, 362, 363, 364. In the illustrated example, a length of arrows 351, 352, 353 and 361, 362, 363, 364 represents an example of a respective driving force of fluid pumping element 350 and fluid pumping element 360 and, therefore, an example of a respective net result of fluid pumped and/or moved toward, to (including into), and/or through fluid ejection chamber 310 and fluid ejection chamber 320.

In one implementation, fluid pumping element 350 may be operated to pump or move the first fluid toward, to (including into), and/or through fluid ejection chamber 320, and fluid pumping element 360 may be operated to pump or move the second fluid toward, to (including into), and/or through fluid ejection chamber 310. As such, as illustrated in the example of FIG. 3, a mixture or combination of the first fluid and the second fluid, including different ratios or concentrations of the first fluid and the second fluid, may be formed or created, as represented by combined hatching 399.

In one example, a mixing zone 370, in which a mixture or combination of the first fluid and the second fluid may be formed or created, is provided or established between fluid pumping element 350 and fluid pumping element 360, including, more specifically, between fluid pumping element 350 and fluid ejection chamber 320, between fluid pumping element 360 and fluid ejection chamber 310, and, therefore, between fluid ejection chamber 310 and fluid ejection chamber 320. In one implementation, mixing zone 370 includes fluid ejection chamber 310 and/or fluid ejection chamber 320. Thus, with mixing zone 370, a mixture or combination of the first fluid and the second fluid is created or formed on substrate 306 of fluid ejection device 300.

As such, based on operation of fluid pumping element 350 and/or fluid pumping element 360, fluid ejection device 300, including, more specifically, fluid ejection devices 301, 302, 303, 304, may be operated to selectively or separately eject drops of the first fluid, drops of the second fluid, and drops of a combination or mixture of the first fluid and the second fluid, including different ratios or concentrations of the first fluid and the second fluid, from fluid ejection chamber 310 and/or fluid ejection chamber 320.

In one example, as illustrated with fluid ejection device 301, the first fluid, as represented by hatching 397, is pumped or moved to and/or through fluid ejection chamber 310, and the second fluid, as represented by hatching 398, is pumped or moved to and/or through fluid ejection chamber 320. As such, the first fluid may be ejected from fluid ejection chamber 310, and the second fluid may be ejected from fluid ejection chamber 320.

In one example, as illustrated with fluid ejection device 302, a greater amount of the first fluid, as represented by hatching 397, is pumped or moved through fluid ejection chamber 310 and toward and/or to fluid ejection chamber 320, and a lesser amount of the second fluid, as represented by hatching 398, is pumped or moved toward and/or to fluid ejection chamber 320 such that the first fluid and the second fluid mix or combine in mixing zone 370, including in fluid ejection chamber 320. As such, the first fluid may be ejected from fluid ejection chamber 310, and a combination or mixture of the first fluid and the second fluid, as represented by combined hatching 399, may be ejected from fluid ejection chamber 320.

In one example, as illustrated with fluid ejection device 303, a lesser amount of the first fluid, as represented by hatching 397, is pumped or moved toward and/or to fluid ejection chamber 310, and a greater amount of the second fluid, as represented by hatching 398, is pumped or moved through fluid ejection chamber 320 and toward and/or to fluid ejection chamber 310 such that the first fluid and the second fluid mix or combine in mixing zone 370, including in fluid ejection chamber 310. As such, the second fluid may be ejected from fluid ejection chamber 320, and a combination or mixture of the first fluid and the second fluid, as represented by combined hatching 399, may be ejected from fluid ejection chamber 310.

In one example, as illustrated with fluid ejection device 304, the second fluid, as represented by hatching 398, is pumped or moved through fluid ejection chamber 320 and to and/or through fluid ejection chamber 310. As such, the second fluid may be ejected from fluid ejection chamber 320 and/or fluid ejection chamber 310. In other examples, the first fluid may pumped or moved through fluid ejection chamber 310 and to and/or through fluid ejection chamber 320 such that the first fluid may be ejected from fluid ejection chamber 310 and/or fluid ejection chamber 320.

Further to the illustrated example of FIG. 3, first fluid channel 330 and second fluid channel 340, including portions, sections, segments or regions thereof, may be of different or varying widths, and may be of different or varying lengths.

Figure 4:
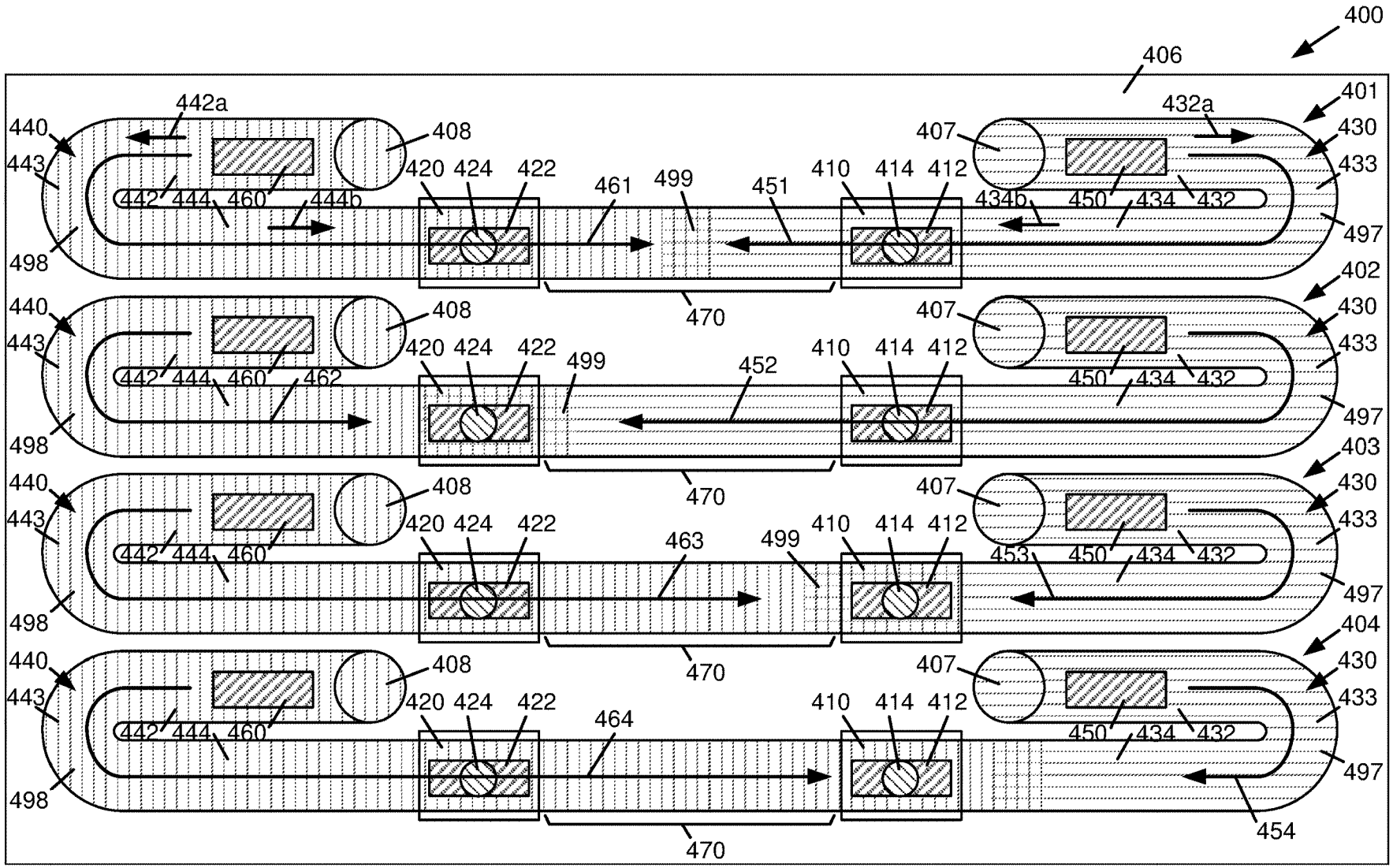
FIG. 4 is a schematic plan view illustrating an example of a portion of a fluid ejection device.

FIG. 4 is a schematic plan view illustrating an example of a portion of a fluid ejection device 400. In one example, fluid ejection device 400 includes an array of fluid ejection devices, such as fluid ejection devices 401, 402, 403, 404.

In one implementation, fluid ejection device 400, including, more specifically, each of fluid ejection devices 401, 402, 403, 404, includes a first fluid ejection chamber 410 with a corresponding drop ejecting element 412 formed in, provided within, or communicated with fluid ejection chamber 410, a second fluid ejection chamber 420 with a corresponding drop ejecting element 422 formed in, provided within, or communicated with fluid ejection chamber 420, a first fluid channel 430 communicated with fluid ejection chamber 410, and a second fluid channel 440 communicated with fluid ejection chamber 420.

In one example, fluid ejection chambers 410 and 420 and corresponding drop ejecting elements 412 and 422 are formed on a substrate 406. Substrate 406 may be formed, for example, of silicon, glass, or a stable polymer.

In one example, substrate 406 has a first fluid feed opening 407 formed therein and a second fluid feed opening 408 formed therein such that first fluid feed opening 407 provides a supply of a first fluid (or ink) to fluid ejection chamber 410 and corresponding drop ejecting element 412 via first fluid channel 430, and second fluid feed opening 408 provides a supply of a second fluid (or ink) to fluid ejection chamber 420 and corresponding drop ejecting element 422 via second fluid channel 440. First fluid feed opening 407 and second fluid feed opening 408 each include, for example, a hole, slot, passage, convex geometry or other fluidic architecture formed in or through substrate 406 by which or through which fluid is supplied to fluid ejection chambers 410 and 420. First fluid feed opening 407 and second fluid feed opening 408 each may include one (i.e., a single) or more than one (e.g., a series of) such hole, slot, passage, convex geometry or other fluidic architecture that communicates fluid with one (i.e., a single) or more than one fluid ejection chamber, and may be of circular, non-circular, or other shape.

In one example, fluid ejection chambers 410 and 420 are formed in or defined by a barrier layer (not shown) provided on substrate 406, such that fluid ejection chambers 410 and 420 each provide a "well" in the barrier layer. The barrier layer may be formed, for example, of a photoimageable epoxy resin, such as SU8. In one example, a nozzle or orifice layer (not shown) is formed or extended over the barrier layer such that nozzle openings or orifices 414 and 424 formed in the orifice layer communicate with respective fluid ejection chambers 410 and 420. Nozzle openings or orifices 414 and 424 may be of a circular, non-circular, or other shape.

Drop ejecting elements 412 and 422 can be any device capable of ejecting fluid drops through corresponding nozzle openings or orifices 414 and 424. Examples of drop ejecting elements 412 and 422 include a thermal resistor or a piezoelectric actuator. A thermal resistor, as an example of a drop ejecting element, may be formed on a surface of a substrate (substrate 406), and may include a thin-film stack including an oxide layer, a metal layer, and a passivation layer such that, when activated, heat from the thermal resistor vaporizes fluid in corresponding fluid ejection chamber 410 or 420, thereby causing a bubble that ejects a drop of fluid through corresponding nozzle opening or orifice 414 or 424. A piezoelectric actuator, as an example of a drop ejecting element, generally includes a piezoelectric material provided on a moveable membrane communicated with corresponding fluid ejection chamber 410 or 420 such that, when activated, the piezoelectric material causes deflection of the membrane relative to corresponding fluid ejection chamber 410 or 420, thereby generating a pressure pulse that ejects a drop of fluid through corresponding nozzle opening or orifice 414 or 424. Although illustrated as being of a rectangular shape, drop ejecting elements 412 and 422 and corresponding fluid ejection chambers 410 and 420 each may be of a different shape and a different size.

As illustrated in the example of FIG. 4, fluid ejection device 400, including, more specifically, each of fluid ejection devices 401, 402, 403, 404, includes a first fluid pumping element 450 formed in, provided within, or communicated with first fluid channel 430, and a second fluid pumping element 460 formed in, provided within, or communicated with second fluid channel 440. More specifically, fluid pumping element 450 and fluid pumping element 460 are each formed on, provided on, or integrated with substrate 406.

Fluid pumping element 450 forms or represents an actuator to pump fluid through first fluid channel 430, and fluid pumping element 460 forms or represents an actuator to pump fluid through second fluid channel 440. As such, fluid from first fluid feed opening 407 is forced or moved through first fluid channel 430 to fluid ejection chamber 410 based on flow induced by fluid pumping element 450, and fluid from second fluid feed opening 408 is forced or moved through second fluid channel 440 to fluid ejection chamber 420 based on flow induced by fluid pumping element 460.

In the example illustrated in FIG. 4, drop ejecting elements 412 and 422 and fluid pumping elements 450 and 460 are each thermal resistors. Each of the thermal resistors may include, for example, a single resistor, a split resistor, a comb resistor, or multiple resistors. A variety of other devices, however, can also be used to implement drop ejecting elements 412 and 422 and fluid pumping elements 450 and 460 including, for example, a piezoelectric actuator, an electrostatic (MEMS) membrane, a mechanical/impact driven membrane, a voice coil, and a magneto-strictive drive.

As illustrated in the example of FIG. 4, first fluid channel 430 communicates with a first fluid (or ink), as represented by hatching 497, and second fluid channel 440 communicates with a second fluid (or ink), as represented by hatching 498. More specifically, in one implementation, first fluid channel 430 communicates with first fluid feed opening 407 to supply the first fluid (or ink) to fluid ejection chamber 410, and second fluid channel 440 communicates with second fluid feed opening 408 to supply the second fluid (or ink) to fluid ejection chamber 420.

In one example, first fluid channel 430 includes a path or channel portion 432 communicated with fluid feed opening 407, a path or channel portion 434 communicated with fluid ejection chamber 410, and a channel loop 433 extended between channel portion 432 and channel portion 434. In addition, second fluid channel 440 includes a path or channel portion 442 communicated with fluid feed opening 408, a path or channel portion 444 communicated with fluid ejection chamber 420, and a channel loop 443 extended between channel portion 442 and channel portion 444.

In one example, channel loop 433 and channel loop 443 each include a U-shaped portion such that a length (or portion) of channel portion 432 and a length (or portion) of channel portion 434 are spaced from and oriented substantially parallel with each other, and a length (or portion) of channel portion 442 and a length (or portion) of channel portion 444 are spaced from and oriented substantially parallel with each other. As such, in one example, channel portion 432 directs fluid in a first direction (arrow 432*a*) between fluid feed opening 407 and channel loop 433, and channel portion 434 directs fluid in a second direction (arrow 434*b*) opposite the first direction between channel loop 433 and fluid ejection chamber 410. In addition, channel portion 442 directs fluid in a first direction (arrow 442*a*) between fluid feed opening 408 and channel loop 443, and channel portion 444 directs fluid in a second direction (arrow 444*b*) opposite the first direction between channel loop 443 and fluid ejection chamber 420.

In one example, fluid pumping element 450 is formed in, provided within, or communicated with channel portion 432 of first fluid channel 430, and fluid pumping element 460 is formed in, provided within, or communicated with channel portion 442 of second fluid channel 440. As such, fluid pumping element 450 forms an asymmetry to first fluid channel 430 and fluid pumping element 460 forms an asymmetry to second fluid channel 440 whereby a fluid flow distance between fluid pumping element 450 and fluid feed opening 407 is less than a fluid flow distance between fluid pumping element 450 and fluid ejection chamber 410, and a fluid flow distance between fluid pumping element 460 and fluid feed opening 408 is less than a fluid flow distance between fluid pumping element 460 and fluid ejection chamber 420.

In one implementation, fluid pumping element 450 may be operated to pump or move the first fluid toward, to (including into), and/or through fluid ejection chamber 410, as represented by arrows 451, 452, 453, 454, and fluid pumping element 460 may be operated to pump or move the second fluid toward, to (including into), and/or through fluid ejection chamber 420, as represented by arrows 461, 462, 463, 464. In the illustrated example, a length of arrows 451, 452, 453, 454 and 461, 462, 463, 464 represents an example of a respective driving force of fluid pumping element 450 and fluid pumping element 460 and, therefore, an example of a respective net result of fluid pumped and/or moved toward, to (including into), and/or through fluid ejection chamber 410 and fluid ejection chamber 420.

In one implementation, fluid pumping element 450 may be operated to pump or move the first fluid toward, to (including into), and/or through fluid ejection chamber 420, and fluid pumping element 460 may be operated to pump or move the second fluid toward, to (including into), and/or through fluid ejection chamber 410. As such, as illustrated in the example of FIG. 4, a mixture or combination of the first fluid and the second fluid, including different ratios or concentrations of the first fluid and the second fluid, may be formed or created, as represented by combined hatching 499.

In one example, a mixing zone 470, in which a mixture or combination of the first fluid and the second fluid may be formed or created, is provided or established between fluid pumping element 450 and fluid pumping element 460, including, more specifically, between fluid pumping element 450 and fluid ejection chamber 420, between fluid pumping element 460 and fluid ejection chamber 410, and, therefore, between fluid ejection chamber 410 and fluid ejection chamber 420. In one implementation, mixing zone 470 includes fluid ejection chamber 410 and/or fluid ejection chamber 420. Thus, with mixing zone 470, a mixture or combination of the first fluid and the second fluid is created or formed on substrate 406 of fluid ejection device 400.

As such, based on operation of fluid pumping element 450 and/or fluid pumping element 460, fluid ejection device 400, including, more specifically, fluid ejection devices 401, 402, 403, 404, may be operated to selectively or separately eject drops of the first fluid, drops of the second fluid, and drops of a combination or mixture of the first fluid and the second fluid, including different ratios or concentrations of the first fluid and the second fluid, from fluid ejection chamber 410 and/or fluid ejection chamber 420.

In one example, as illustrated with fluid ejection device 401, the first fluid, as represented by hatching 497, is pumped or moved to and/or through fluid ejection chamber 410, and the second fluid, as represented by hatching 498, is pumped or moved to and/or through fluid ejection chamber 420. As such, the first fluid may be ejected from fluid ejection chamber 410, and the second fluid may be ejected from fluid ejection chamber 420.

In one example, as illustrated with fluid ejection device 402, a greater amount of the first fluid, as represented by hatching 497, is pumped or moved through fluid ejection chamber 410 and toward and/or to fluid ejection chamber 420, and a lesser amount of the second fluid, as represented by hatching 498, is pumped or moved toward and/or to fluid ejection chamber 420 such that the first fluid and the second fluid mix or combine in mixing zone 470, including in fluid ejection chamber 420. As such, the first fluid may be ejected from fluid ejection chamber 410, and a combination or mixture of the first fluid and the second fluid, as represented by combined hatching 499, may be ejected from fluid ejection chamber 420.

In one example, as illustrated with fluid ejection device 403, a lesser amount of the first fluid, as represented by hatching 497, is pumped or moved toward and/or to fluid ejection chamber 410, and a greater amount of the second fluid, as represented by hatching 498, is pumped or moved through fluid ejection chamber 420 and toward and/or to fluid ejection chamber 410 such that the first fluid and the second fluid mix or combine in mixing zone 470, including in fluid ejection chamber 410. As such, the second fluid may be ejected from fluid ejection chamber 420, and a combination or mixture of the first fluid and the second fluid, as represented by combined hatching 499, may be ejected from fluid ejection chamber 410.

In one example, as illustrated with fluid ejection device 404, the second fluid, as represented by hatching 498, is pumped or moved through fluid ejection chamber 420 and to and/or through fluid ejection chamber 410. As such, the second fluid may be ejected from fluid ejection chamber 420 and/or fluid ejection chamber 410. In other examples, the first fluid may pumped or moved through fluid ejection chamber 410 and to and/or through fluid ejection chamber 420 such that the first fluid may be ejected from fluid ejection chamber 410 and/or fluid ejection chamber 420.

Further to the illustrated example of FIG. 4, first fluid channel 430 and second fluid channel 440, including portions, sections, segments or regions thereof, may be of different or varying widths, and may be of different or varying lengths.

Figure 5:
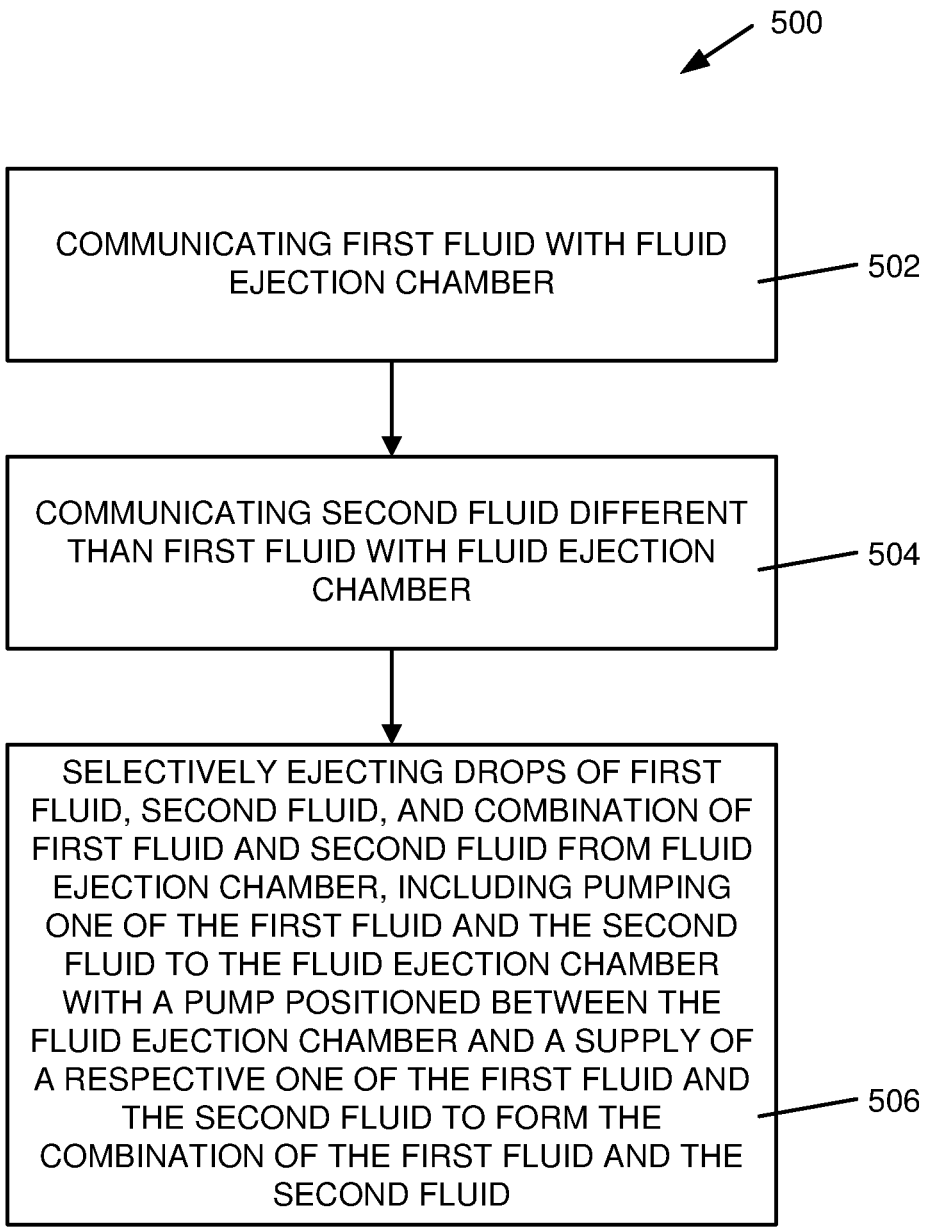
FIG. 5 is a flow diagram illustrating an example of a method of operating a fluid ejection device.

FIG. 5 is a flow diagram illustrating an example of a method 500 of operating a fluid ejection device, such as fluid ejection devices 200, 300, 400, as illustrated in the respective examples of FIGS. 2, 3, 4.

At 502, method 500 includes communicating a first fluid with a fluid ejection chamber, such as a first fluid, as represented by hatching 297, and as included, for example, in a combination or mixture of the first fluid and a second fluid, as represented by combined hatching 299, communicated with fluid ejection chamber 210, a first fluid, as represented by hatching 397, and as included, for example, in a combination or mixture of the first fluid and a second fluid, as represented by combined hatching 399, communicated with fluid ejection chamber 310, and a first fluid, as represented by hatching 497, and as included, for example, in a combination or mixture of the first fluid and a second fluid, as represented by combined hatching 499, communicated with fluid ejection chamber 410.

At 504, method 500 includes communicating a second fluid different than the first fluid with the fluid ejection chamber, such as a second fluid, as represented by hatching 298, and as included, for example, in a combination or mixture of a first fluid and the second fluid, as represented by combined hatching 299, communicated with fluid ejection chamber 210, a second fluid, as represented by hatching 398, and as included, for example, in a combination or mixture of a first fluid and the second fluid, as represented by combined hatching 399, communicated with fluid ejection chamber 310, and a second fluid, as represented by hatching 498, and as included, for example, in a combination or mixture of a first fluid and the second fluid, as represented by combined hatching 499, communicated with fluid ejection chamber 410.

At 506, method 500 includes selectively ejecting drops of the first fluid, the second fluid, and a combination of the first fluid and the second fluid from the fluid ejection chamber, such as drops of a first fluid, as represented by hatching 297, 397, 497, ejected from respective fluid ejection chambers 210, 310, 410, drops of a second fluid, as represented by hatching 298, 398, 498, ejected from respective fluid ejection chambers 210, 310, 410, and a combination of a first fluid and a second fluid, as represented by combined hatching 299, 399, 499, ejected from respective fluid ejection chambers 210, 310, 410.

Although illustrated and described as separate and/or sequential steps, the method may include a different order or sequence of steps, and may combine one or more steps or perform one or more steps concurrently, partially or wholly.

With a fluid ejection device as disclosed herein, drops of a first fluid, drops of a second fluid (different than the first fluid), and drops of a mixture or combination of the first fluid and the second fluid, including different ratios or concentrations of the first fluid and the second fluid, may be selectively or separately ejected. More specifically, a mixture or combination of a first fluid and a second fluid may be created or formed on a substrate of the fluid ejection device prior to ejection.

In examples, the first fluid and the second fluid are or include different dyes, pigments, constituents, substances, agents, reactants or reagents. As such, a fluid ejection device as disclosed herein provides for blending the different dyes, pigments, constituents, substances, agents, reactants or reagents on the substrate. Thus, a fluid ejection device as disclosed herein provides for blending different dyes, pigments, constituents, substances, agents, reactants or reagents prior to ejection.

In examples, the first fluid and the second fluid are fluids of different colors (i.e., native colors). As such, a fluid ejection device as disclosed herein provides for creating various combinations of the native colors on the substrate. Thus, a fluid ejection device as disclosed herein provides for creating various combinations of native colors prior to ejection. In addition, a fluid ejection device as disclosed herein provides for color mixing on-demand.

Although specific examples have been illustrated and described herein, it will be appreciated by those of ordinary skill in the art that a variety of alternate and/or equivalent implementations may be substituted for the specific examples shown and described without departing from the scope of the present disclosure. This application is intended to cover any adaptations or variations of the specific examples discussed herein.

The invention claimed is:

1. A fluid ejection device, comprising:

a fluid ejection chamber having a drop ejecting element therein;

a first fluid channel to communicate a first fluid with the fluid ejection chamber;

a second fluid channel to communicate a second fluid different than the first fluid with the fluid ejection chamber;

a fluid pump communicated with one of the first fluid channel and the second fluid channel, and a mixing zone between the fluid pump and the fluid ejection chamber to form a combination of the first fluid and the second fluid, the first channel to direct the first fluid to the mixing zone in a first direction along a first axis, and the second channel to direct the second fluid to the mixing zone in a second direction opposite the first direction along a second axis coaxial with the first axis, the fluid ejection chamber to selectively eject drops of the first fluid, the second fluid, and the combination of the first fluid and the second fluid therefrom.

2. The fluid ejection device of claim 1, wherein the fluid pump is to move a respective one of the first fluid and the second fluid to the fluid ejection chamber.

3. The fluid ejection device of claim 2, wherein an extent of operation of the fluid pump is to control an amount of the respective one of the first fluid and the second fluid moved to the fluid ejection chamber.

4. The fluid ejection device of claim 1, wherein the fluid ejection chamber having the drop ejecting element therein comprises a first fluid ejection chamber having a first drop ejecting element therein, wherein the fluid pump comprises a first fluid pump communicated with the first fluid channel, and further comprising:

a second fluid ejection chamber having a second drop ejecting therein; and a second fluid pump communicated with the second fluid channel, the second fluid ejection chamber to selectively eject drops of the first fluid, the second fluid, and a combination of the first fluid and the second fluid therefrom.

5. The fluid ejection device of claim 4, further comprising:

the mixing zone between the first fluid ejection chamber and the second fluid ejection chamber to produce the combination of the first fluid and the second fluid.

6. The fluid ejection device of claim 1, wherein at least one of the first fluid channel and the second fluid channel includes a first portion communicated with a supply of the respective one of the first fluid and the second fluid, a second portion communicated with the fluid ejection chamber, and a channel loop between the first portion and the second portion.

7. The fluid ejection device of claim 6, wherein the first portion is to direct fluid in a first direction, and the second portion is to direct fluid in a second direction opposite the first direction.

8. A fluid ejection device, comprising:

a first fluid opening to supply a first fluid;

a second fluid opening to supply a second fluid different than the first fluid;

a fluid nozzle to selectively eject drops of the first fluid, the second fluid, and a mixture of the first fluid and the second fluid;

a fluid pump between the fluid nozzle and one of the first fluid opening and the second fluid opening to pump a respective one of the first fluid and the second fluid to the fluid nozzle; and a mixing zone between the fluid pump and the fluid nozzle to mix the first fluid and the second fluid, the first fluid and the second fluid to be supplied to the mixing zone in opposite directions along a common axis.

9. The fluid ejection device of claim 8, wherein the fluid nozzle comprises a first fluid nozzle, and further comprising:

a second fluid nozzle to selectively eject drops of the first fluid, the second fluid, and a mixture of the first fluid and the second fluid; and the mixing zone between the first fluid nozzle and the second fluid nozzle to mix the first fluid and the second fluid, wherein the fluid pump is to selectively pump the respective one of the first fluid and the second fluid to the first fluid nozzle and the mixing zone.

10. The fluid ejection device of claim 9, wherein the fluid pump comprises a first fluid pump between the first fluid nozzle and the first fluid opening, and further comprising:

a second fluid pump between the second fluid nozzle and the second fluid opening to selectively pump the second fluid to the second fluid nozzle and the mixing zone.

11. A method of operating a fluid ejection device, comprising:

communicating a first fluid with a fluid ejection chamber;

communicating a second fluid different than the first fluid with the fluid ejection chamber; and selectively ejecting drops of the first fluid, the second fluid, and a combination of the first fluid and the second fluid from the fluid ejection chamber, including pumping one of the first fluid and the second fluid to the fluid ejection chamber with a pump positioned between the fluid ejection chamber and a supply of a respective one of the first fluid and the second fluid and mixing the first fluid and the second fluid in a mixing zone between the fluid pump and the fluid ejection chamber to form the combination of the first fluid and the second fluid, including supplying the first fluid and the second fluid to the mixing zone in opposite directions along a common axis.

12. The method of claim 11, further comprising:

communicating the first fluid with an additional fluid ejection chamber;

communicating the second fluid with the additional fluid ejection chamber; and selectively ejecting drops of the first fluid, the second fluid, and a combination of the first fluid and the second fluid from the additional fluid ejection chamber, including pumping another of the first fluid and the second fluid to the additional fluid ejection chamber with an additional pump positioned between the additional fluid ejection chamber and a supply of the another of the first fluid and the second fluid to form the combination of the first fluid and the second fluid.

* * * * *